428-919 SR
8/31/76 XR 3,977,927

United States Patent [19]
Amos et al.

[11] 3,977,927
[45] Aug. 31, 1976

[54] MACHINE AND METHOD FOR MAKING CAMOUFLAGE NETS

[75] Inventors: Homer C. Amos, Palm Springs, Calif.; Samuel R. Callis, Marion; Charles R. Scott, Sugar Grove, both of Va.

[73] Assignee: Brunswick Corporation, Skokie, Ill.

[22] Filed: Jan. 13, 1975

[21] Appl. No.: 540,495

[52] U.S. Cl. ..... 156/61; 156/351; 156/361; 156/366; 156/494; 156/552; 156/556; 428/17; 428/919

[51] Int. Cl.[2] ..... B44D 5/10

[58] Field of Search ..... 428/919, 17; 156/351, 156/361, 366, 494, 552, 556, 61, 93

[56] References Cited

UNITED STATES PATENTS

| | | | |
|---|---|---|---|
| 1,817,871 | 8/1931 | Brandt | 428/919 |
| 2,825,168 | 3/1958 | Ekman | 428/919 |
| 3,069,796 | 12/1962 | Ruter | 428/136 |
| 3,661,689 | 5/1972 | Spanier | 428/919 |

*Primary Examiner*—Edward G. Whitby
*Attorney, Agent, or Firm*—John G. Heimovics; David S. Guttman

[57] ABSTRACT

This invention comprehends a machine for producing camouflage nets. Different camouflage garnish patterns are secured to a net in a preselected and predetermined manner on a repetitive basis. Also, comprehended is a method of making a camouflage net by providing different shape camouflage garnish pieces that are applied to a net at predesignated work stations.

13 Claims, 8 Drawing Figures

10
12
14
16
18
20
22
23
24
26
28
30
36
38
40
41
42
43
44
48
NET SECURING STATION
NET REMOVAL STATION
INSPECTION STATION 100
102
104
50

Fig. 5
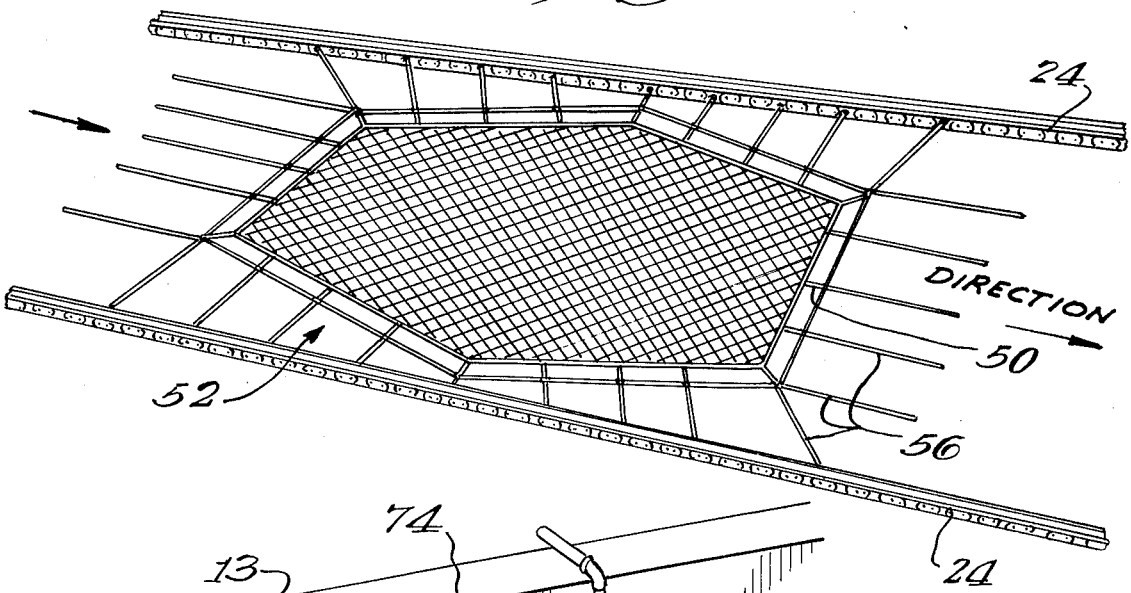
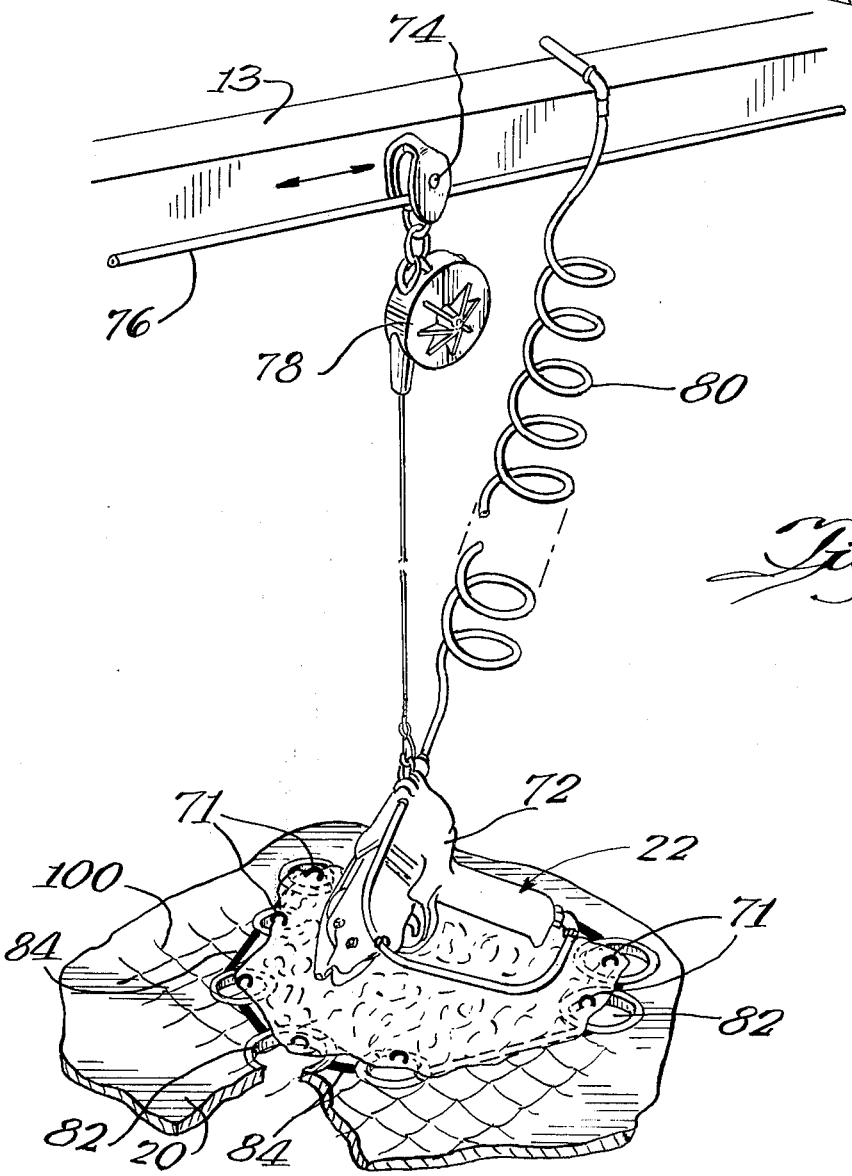
Fig. 4

MACHINE AND METHOD FOR MAKING CAMOUFLAGE NETS

BACKGROUND OF THE INVENTION

1. Field of the Invention

This invention relates to a machine for producing camouflage nets, and more particularly, relates to a machine for producing camouflage nets wherein camouflage garnish is attached to a net in a preselected and predetermined manner.

2. Background of the Prior Art

It is well known in the prior art to make large sections of camouflage by employing netting of a pliable nature with intertwined strips of colored fabric or other material that provides the desired color effect or texture. When such a net is spread out, objects underneath may be concealed from over flying airplanes or from ground observation. In U.S. Pat. No. 2,351,142 a method of making camouflage material is taught by cutting a series of offset transverse slits in a roll of camouflage material so that when the material is pulled at 90° to the slits it will expand into a partial hexagonal shape. When this material is draped over an object, such as an airplane, it is supposed to act as a camouflaged netting. Other embodiments are taught such as short strips of colored material attached to a net and used as a camouflage net although it only looks like a net with strips. In U.S. Pat. No. 3,069,796 a camouflage material that has offset and opposite U-shaped cut portions extending throughout the material is taught. It is claimed that due to the cuts the material expands and drapes thereby better hiding what can optically be seen from an airplane. In addition, it was taught that different color patterns may be combined to give the optical appearance of the ground or other such land area that is desired to be reproduced. However, nowhere is there any teaching of a method or machine for taking a camouflage garnish such as that shown in U.S. Pat. No. 3,069,796 and attaching it to preselected nets which may be hexagonal, square, rectangular, diamond shape, etc. to form a camouflage net. Thus, the prior art fails to teach how to utilize the state of the art of camouflage garnish and conveniently, efficiently prepare camouflage nets therewith in a simple but automatic manner.

SUMMARY OF THE INVENTION

This invention relates to a machine used in the assembly of a fabric, such as camouflage garnish, to a net. The machine broadly comprises (1) a frame with conveyor chains at either side, (2) a plurality of work stations mounted on the upper side of the frame, (3) a plurality of work stations located underneath the frame, (4) means for attaching the net to the conveyor chains so that it can be pulled through the machine past the work stations in an indexed or intermittent fashion, and (5) means for attaching in a preselected fashion fabric to the net. This machine solves the problems unanswered by the prior art whereby it is possible to produce camouflage netting automatically, simply and reproducibly. As used herein, (1) the term "net" is defined as an open network of crossed and tied strands with a much heavier strand or edge cord defining the outer geometric configuration thereof; (2) the term "garnish" or "camouflage garnish" is defined as a precut, pre-colored pliable fabric having sizing cuts therein (such as taught in U.S. Pat. No. 3,069,096) and much smaller than the net; and, (3) the term "camouflage net" is defined as nets having a garnish secured thereto.

It is therefore an object of this invention to provide a machine capable of producing a net with fabric secured thereto in a preselected manner.

It is another object of this invention to provide a machine capable of producing a camouflage net having camouflage garnish attached to the netting in a preselected fashion.

Yet another object of the invention is to provide a simple means, such as hog rings, for attaching the camouflage garnish to such camouflage netting.

And yet another object of the invention is to provide a method of making a camouflage net.

It is a feature of this invention to utilize the basic camouflage garnish taught in the U.S. Pat. No. 3,069,796 and to provide a finished camouflage net with the garnish attached thereto in and made in a manner where it can be reproduced over and over again.

The above and other and further objects and features will be more readily understood by reference to the following detailed description and the accompanying drawings.

DESCRIPTION OF THE DRAWINGS

FIG. 4 is a prospective view of a hog ring gun and partial segment of a work station;

FIG. 5 is a prospective view of a net secured to the conveyor chains;

DESCRIPTION OF THE PREFERRED EMBODIMENTS

This invention comprehends a machine that comprises a frame supported by legs with two spaced apart conveyor drive chains and a plurality of upper work stations and lower work stations. A net is secured at a lower work station to the conveyor chains and conveyed to the upper work stations wherein camouflage garnish is attached in a preselected manner by using hog ring guns. Upon being detached at the final station the camouflage netting may be removed and used as is, or may be introduced into a substantially identical second machine to have additional camouflage garnish applied thereto. It has been found both advantageous and necessary to have a plurality of indexing stations so that several camouflage nets are being processed in the machine concurrently. This garnish attachment work is accomplished by individuals standing on the machine at the work stations and manually positioning the camouflage garnish on the net and then semiautomatically attaching it to the net. After all attached stations have completed their work a completed camouflage net is indexedly moved under the frame (but still attached to the machine) to an inspection station where any loose camouflage is attached to the netting and finally the netting is moved to a detaching station and removed from the machine. This machine makes it possible to have camouflage garnish applied to netting in a repetitively preselected manner so that camouflage nets may be produced in an automated fashion thus satisfying a long felt need that was unsolved by the prior art.

Figure 1:
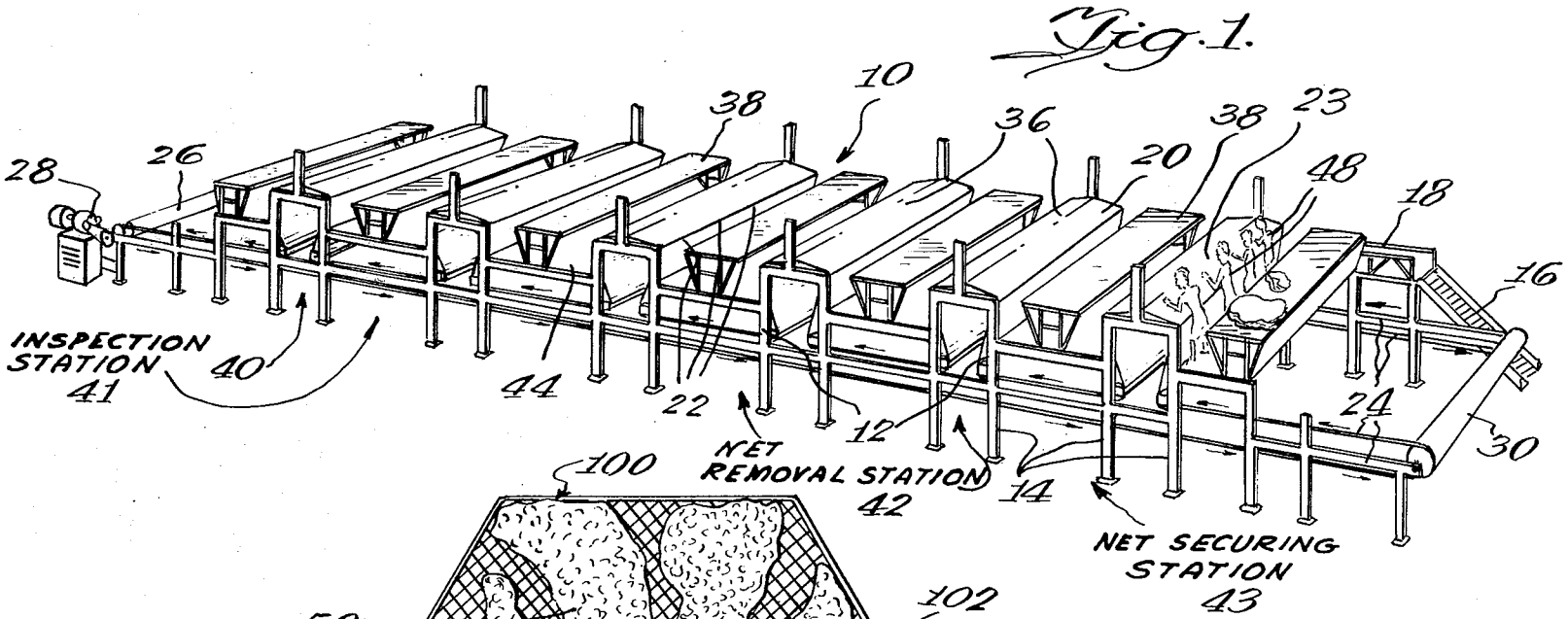
FIG. 1 is a perspective view of the top and side of the invention.

In the preferred embodiment of the invention, as shown in FIG. 1, machine 10 has a frame 12 supported by legs 14. On the one side of the machine attached to the frame is stairway 16 leading to platform 18 that enables the individuals 48 working on the machine to get to the work station 22. The work surfaces 20, having a raised center crown 36, are supported by a frame 12 and define pairs of opposite upper work stations 22. Conveyor chains 24 are mounted on either side of the frame, defined as being spaced apart, and are driven by drive roll 26 which is powered by the prime mover 28. At the opposite end of the machine primary idle roll 30 with a take-up (not shown) keeps the chains 24 under proper tension. The work station platform 44 helps define the individual's 48 work area. Garnish support tables 38 are adjacent all work stations 22 and support the camouflage garnish pattern sections 50 prior to their being attached to the net.

Figure 2:
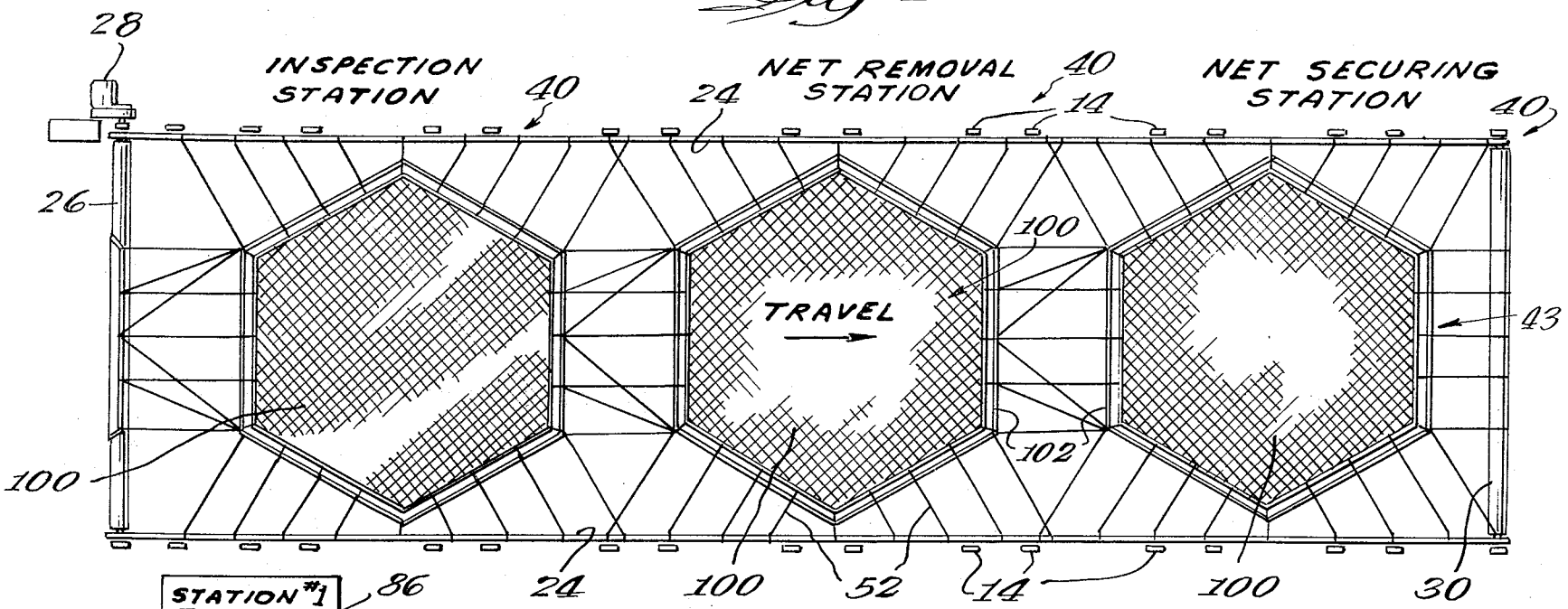
FIG. 2 is a bottom view of the invention showing primarily the netting attachment.

In the bottom view of the machine shown in FIG. 2, and also indicated in FIG. 1, there are three lower work stations 40. The first is the net securing station 43 where the net 100 is attached to the conveyor chains 24 in a desired fashion by means of the rigging 52. With an indexed or intermittent motion the machine 10 is started with the net 100 moving first to the first upper work station 23 wherein individuals 48 are shown. The appropriate garnish 50 is attached to the net 100 at this position while other garnish sections are being attached to other nets located at the other upper work stations 22. As each net 100 is indexed past each of the upper work stations 22 additional garnish pieces 50 are being attached to the net 100 in order to complete it. While this is taking place a different camouflage net is being checked at inspection station 41. Concurrently a finished camouflaged net is being removed at the net removal station 42 and a new net 100 is being connected by means of the rigging 52 to the conveyor chains 24 at the net installation station 43. When everyone working on some stage of the nets on the machine is finished and the switches 86 have been thrown (more fully described hereinafter) the machine indexes with the new net 100 moving to the first upper work station 23 and the other nets moving progressively in line to their next working stations.

Figure 3:
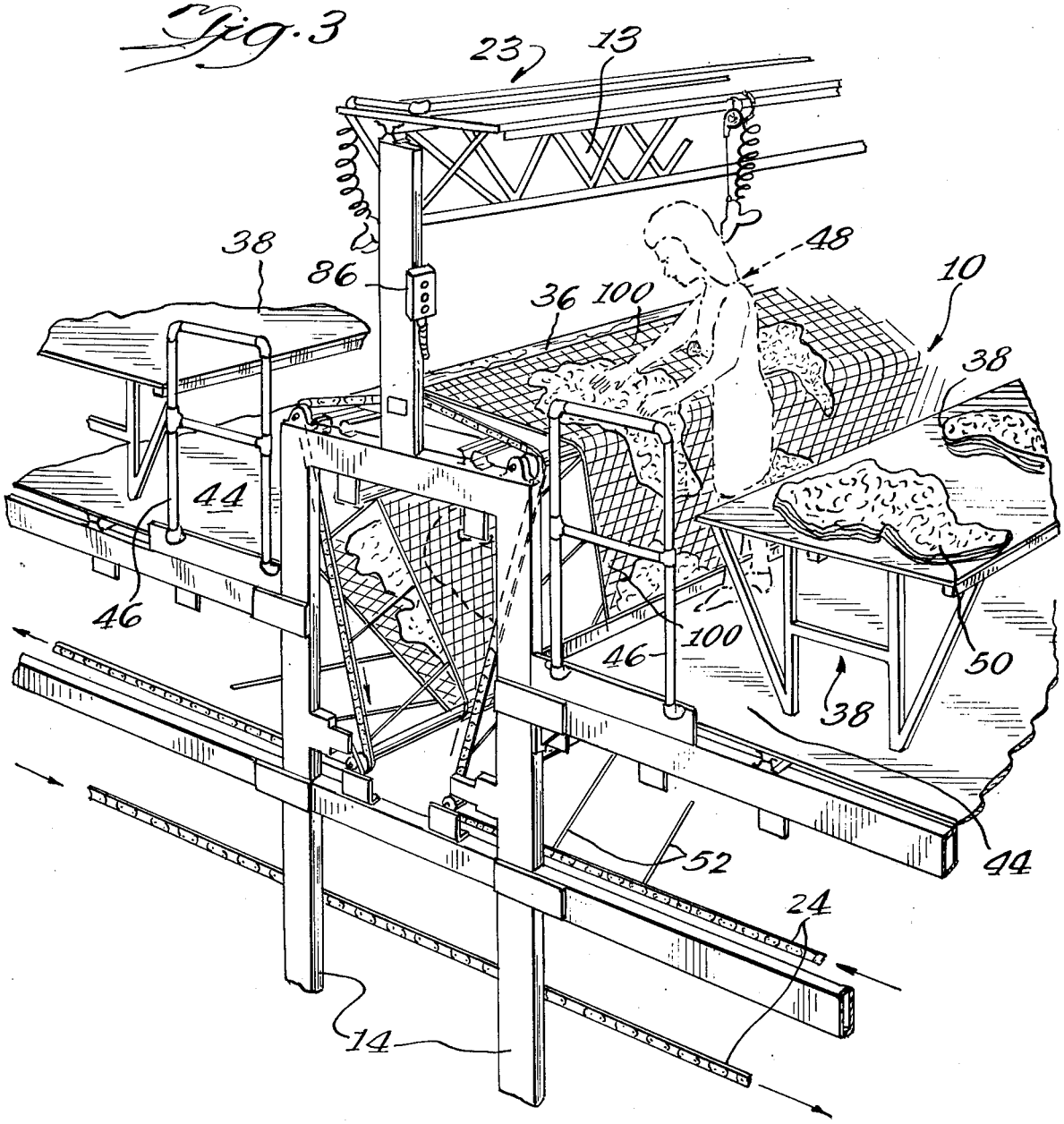
FIG. 3 is a prospective view of a typical upper work station.

In FIGS. 3 and 4, first upper work station 23 is depicted as a typical upper work station where individual 48 (shown in phantom) performs certain operations. First, individual 48 will place a camouflage garnish pattern section 50 on the net 100 locating it according to the garnish pattern holes 82 and garnish pattern guidelines 84. Each hole 82 defines a hog ring position, eliminating guesswork, indecision, and variability. It will be noted that any given operator 48 repeatedly applies hog rings 71 to identical garnish pieces 50 over the same limited identical set of holes 82, thus making his own small portion of the big overall pattern; thereby, the operator more easily learns and rapidly performs his portion of the assembly. The hog ring gun 72 powered by air supply line 80 is attached to counter balance pulley 78 which is on moveable pulley block 74 which traverses back and forth on cable 76 that is attached to the upper portion 13 of frame 12. Thus, individual 48 can grasp and easily pull the hog ring gun into position where hog rings 71 are used to secure the camouflage garnish section 50 to the net 100. Depending upon the number of upper work stations 22 and the size of the net, as many as 100 people, or even more, can be attaching garnish sections 50 to the net 100 at the same time. The pulley block 74 and pulley block cable 76 enable an individual 48 to move laterally along the upper work stations 22 so that several spaced pieces of camouflage garnish sections 50 may be attached to the net 100 by one person. When all individuals 48 working in one row of upper work stations 22, such as shown at 23 in FIG. 1, have completed their work the station finish indicator switch 86 is thrown or pushed. At each upper work station 22 and at each lower work station 40, there are station finish indicator switches 86. When all individuals working both above and beneath have finished their work and pushed their respective switches 86, then the machine moves the nets in an indexed manner to the next work station. When the machine 10 is operated with the switches 86, everyone working on the nets on the machine will have finished before the nets can move; thus, a safety system.

Figure 6:
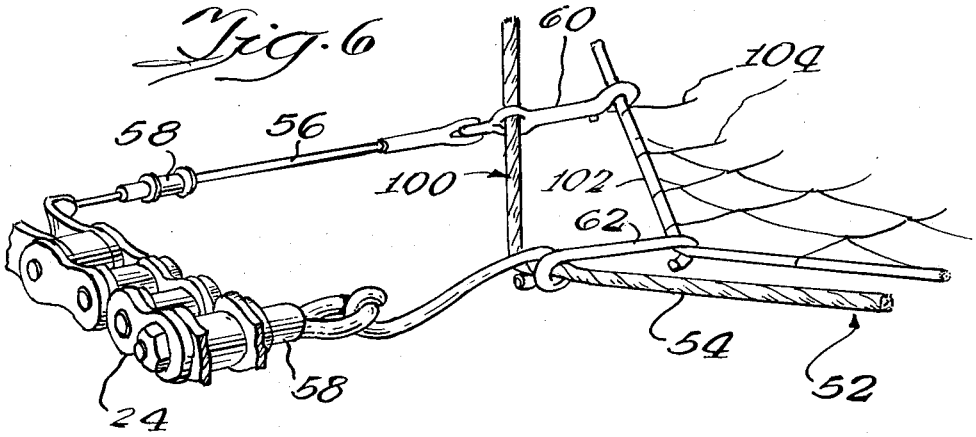
FIG. 6 is a detail of the securing means of FIG. 5.

When a net 100 has had the required garnish 50 attached to it at the upper work stations 22, it moves to the inspection station 41 where any loose ends of the garnish 50 are attached to the net 100. When the machine indexes again, this netting will be removed at the net removal station 42 and taken from underneath the machine 10. In one preferred embodiment where there are six pair of upper work stations 22 and three lower work stations 40, there are nine nets 100 in the machine 10 at one time. In proper sequence the first work station is net securing station 43 where the net is stretched and attached to the conveyor chains 24 by means of the biasing attachment means shown in FIGS. 5 and 6. A plastic coated steel cable 54 in the shape of the outside exterior configuration of the net 100 (if the net is hexagonal then cable 54 will be in an hexagonal arrangement) outlines where the net will be attached to the conveyor chains 24. The cable 54 is attached to the conveyor chains 24 by rigging strands 56 which are connected to the chains 24 by the chain attachment devices 58. The net edge cord 102 is attached to cable 54 by rigging hooks 62 at the apexes of the hex adjacent to chains 24 and the snap hooks 60 that are attached to each of the other rigging strands 56. The rigging 56 is so designed in conjunction with the plastic cable 54 that the net 100, and especially the net edge cord 102 that is actually secured by hooks 60 and 62, is always under tension and taut.

Figure 7:
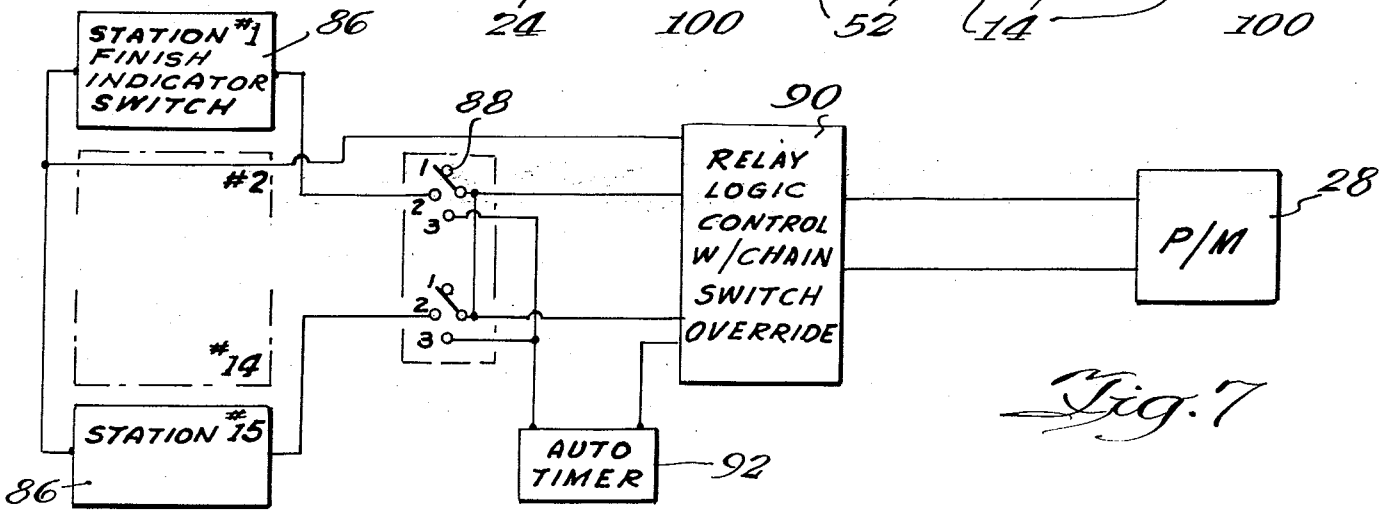
FIG. 7 is a block electrical circuit drawing.

FIG. 7, the schematic drawing of the electrical system, depicts a plurality of station finish indicator switches 86. Each row of work stations 22 has its own switch 86 and each lower inspection station 41, 42 and 43 each has its own switch 86. For simplicity only two switches 86 are shown in FIG. 7 with additional switches 86 from No. 2 to No. 14 being depicted in phantom. One lead from each switch 86 is attached directly into the relay logic controller 90 and the other lead connects into the multiple pole triple throw switch 88. The auto timer 92 is also connected directly to the switch 88 and controller 90. When switch 88 is at its number 1 position the prime mover 28 is turned off and the conveyor chains 24 cannot normally be operated. When a switch 88 is moved to position 2 then the prime mover 28 can move the chains 24 when all switches 86 have been pushed or thrown. After all the switches 86 have been pushed the relay logic controller 90 overrides the chain shutoff switch (not shown) and the prime mover 28 moves the chains 24 until the prime mover 28 is automatically shut off by the chain switch (not shown) when the chains 24 have moved the desired distance to index the nets 100 to the next work stations. If the switch 88 is moved to position 3 the station finish indicator switches 86 are disconnected and an automatic timing device 92 will operate the prime mover 28. Thus, the conveyor chains 24 will automatically move in a preselected timed sequence.

Figure 8:
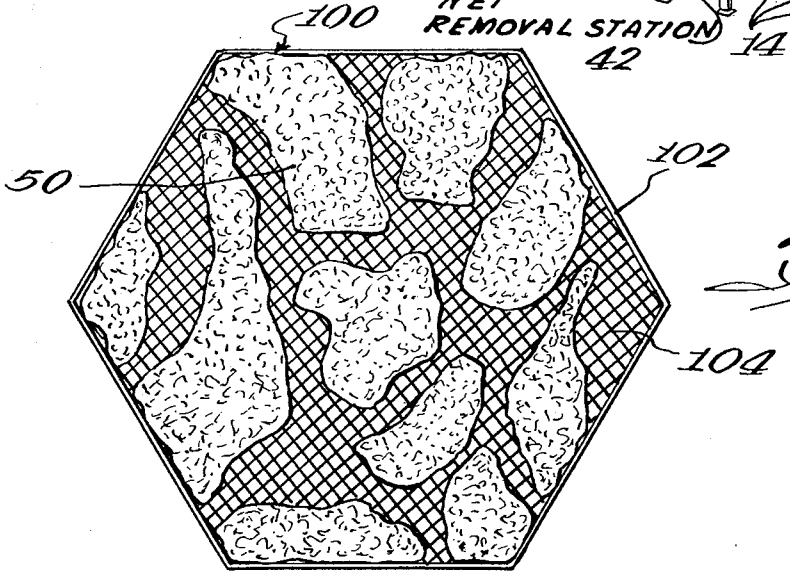
FIG. 8 is a view of a partially finished camouflage net.

The camouflage net 100 after it has been removed from the machine is depicted in FIG. 8. The net 100 has camouflage garnish pattern sections 50 attached thereto with the lace network 104 still optically viewable. If it is desired, and it generally is, the net 100 is turned over so that the additional garnish sections 50 be attached to the second side to cover the entire net; then, this may be accomplished by: (1) changing the work surfaces 20 of the upper work stations 22 to provide new surfaces with preselected garnish pattern holes 82 and garnish pattern guidelines 84 for new series of camouflage garnish sections 50 to be attached to the net 100 and, processing the net through the machine, or (2) by providing a second machine 10 similar to the first machine 10. Alternatively, the net 100 can be completely covered by garnish pieces 50 in just one machine.

By use of the precut camouflage garnish sections and preselected arrangement of the outlines or guidelines for each camouflage garnish section, reproducible camouflage nets are obtained from the machine 10. Moreover, the use of the hog ring gun, the hog rings and the holes in the upper work surfaces provide for accurate attachment of the garnish sections on the net, thus enabling mass production of camouflage nets that has heretofore not been accomplished. Although specific embodiments of the invention have been described, many modifications and changes may be made in the machine or the process without departing from the spirit and scope of the invention as defined in the appended claims.

We claim:

1. A machine used in the assembly of a garnish to a net to form a camouflage net comprising:

a. a frame having a pair of spaced conveyor chains;
b. a plurality of legs supporting the frame;
c. a plurality of first work stations mounted on work supports on the upper side of the frame, the supports comprising work surfaces raised at the center and rollers along each elongated lower edge;
d. a plurality of second work stations located under the frame;
e. a plurality of garnish support tables adjacent the first work stations mounted on the frame;

f. a plurality of bias means secured to the chains for attaching the net to the machine and means for maintaining the net in a taut condition;
g. drive means coupled with controls for indexedly moving the net to the work station in a preselected manner;
h. means provided at the work station for locating the position of the garnish to be attached to the net; and,
i. means for attaching the garnish to the net.

2. The machine of claim 1 wherein the controls include a plurality of finish indicator switches, one located on each row of work stations.

3. The machine of claim 2 wherein all the finish switches must be triggered before the drive means can index the net.

4. The machine of claim 1 wherein the work surfaces are elongated panels.

5. The machine of claim 4 wherein the attachment locating means includes prepositioned holes in the panels.

6. The machine of claim 1 wherein the bias means includes a plurality of rigging attached to a biased cable and hooks.

7. The machine of claim 1 wherein the drive means includes a motor and speed reducer.

8. The machine of claim 1 wherein the means for attaching comprises hog rings.

9. The machine of claim 1 wherein the conveyor chains are synchronously driven by the lead roller.

10. A machine used in the assembly of a fabric to a net comprising:

a. a plurality of work stations mounted on a frame;
b. means for securing the net to the machine;
c. means for moving with an intermittent motion the net in a preselected manner to the work stations;
d. means for positioning the fabric on the net in a preselected manner; and,
e. means for attaching the fabric to the net.

11. The machine of claim 10 wherein the means for moving comprises a pair of conveyor chains mounted on the frame.

12. The machine of claim 10 wherein the means for securing includes means for maintaining the net in a taut position.

13. A method of making a camouflage net by the steps of:

a. providing a plurality of different shaped camouflage garnish pieces;
b. providing a plurality of nets;
c. providng a plurality of work stations having designated areas where the garnish pieces can be attached to each net in a preselected manner; and,
d. attaching the garnish to the nets at the different work stations;
e. indexing the nets from one work station to another.

* * * * *